US006292090B1

(12) United States Patent
Higuchi

(10) Patent No.: US 6,292,090 B1
(45) **Date of Patent: *Sep. 18, 2001**

(54) POSITION DETECTING SWITCH

(75) Inventor: Yoshio Higuchi, Osaka (JP)

(73) Assignee: Funai Electric Co., Ltd., Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/921,469

(22) Filed: Sep. 2, 1997

(30) Foreign Application Priority Data

Aug. 30, 1996 (JP) ..... 8-229622

(51) Int. Cl.[7] ..... H01C 10/30
(52) U.S. Cl. ..... 338/118; 338/160; 338/128
(58) Field of Search ..... 338/118, 160, 338/162, 123, 128, 201

(56) References Cited

U.S. PATENT DOCUMENTS 4,012,710 * 3/1977 Ward et al. ..... 338/128
4,139,831 * 2/1979 Ortlieb et al. ..... 338/128
4,314,666 * 2/1982 Schotten ..... 236/78 R
4,352,084 * 9/1982 Graves et al. ..... 338/127
4,500,866 * 2/1985 Romann et al. ..... 338/126
4,743,882 * 5/1988 Simon ..... 338/184
4,868,646 * 9/1989 Tsuji ..... 358/98
5,286,024 * 2/1994 Winblad ..... 273/148 B
5,561,416 * 10/1996 Marshall et al. ..... 340/456

OTHER PUBLICATIONS

Wolf, S., Guide to Electronic Measurements and Laboratory Practice, p. 19, 1973.*

* cited by examiner

*Primary Examiner*—Lincoln Donovan
*Assistant Examiner*—Kyung S. Lee
(74) *Attorney, Agent, or Firm*—Morgan, Lewis & Bockius LLP

(57) ABSTRACT

A switch circuit including voltage dividing elements for dividing a reference voltage inputted from an external source through a reference voltage input terminal, a fixed contact having metallic patterns formed on a board, and a movable contact coming in contact with the metallic patterns so as to slide thereon. The switch circuit not only divides the reference voltage at a voltage dividing ratio corresponding to a currently selected position of an object whose position is to be detected, but also outputs the divided voltage as an analog signal. Some of the voltage dividing elements that serve to switch the voltage dividing ratios are connected in parallel to one another through the fixed contact and the movable contact.

4 Claims, 4 Drawing Sheets

FIG. 3

| LEVEL | SIGNAL VOLTAGE RANGE | VOLTAGE RANGE FOR MICROCOMPUTER JUDGMENT | CALCULATED CENTER VALUE ±TOLERANCE | |
|---|---|---|---|---|
| (1) | 0v | 0 ~ 0.25v | 0v | - 0<br>+0.25 |
| (2) | 0.36 ~ 0.52v | 0.26 ~ 0.65v | 0.44v | - 1.18v<br>+0.21v |
| (3) | 0.78 ~ 1.08v | 0.66 ~ 1.05v | 0.91v | - 0.25v<br>+0.14v |
| (4) | 1.04 ~ 1.4v | 1.06 ~ 1.50v | 1.21v | - 0.15v<br>+0.29v |
| (5) | 1.58 ~ 2.04v | 1.51 ~ 1.98v | 1.80v | - 0.29v<br>+0.18v |
| (6) | 1.93 ~ 2.42v | 1.99 ~ 2.60v | 2.17v | - 0.18v<br>+0.43v |
| (7) | 2.72 ~ 3.2v | 2.61 ~ 3.19v | 2.97v | - 0.36v<br>+0.22v |
| (8) | 3.17 ~ 3.61v | 3.20 ~ 3.75v | 3.40v | - 0.20v<br>+0.35v |
| (9) | 3.96 ~ 4.26v | 3.76 ~ 4.50v | 4.12v | - 0.36v<br>+0.38v |
| (10) | 5.0v | 4.51 ~ 5.0v | 5.0v | - 0.49v<br>+0v |

POSITION DETECTING SWITCH

BACKGROUND OF THE INVENTION

1. Field of the Invention

The invention relates to a position detecting switch that detects at which selected position out of predetermined selected positions an object whose position is to be detected is located and outputs the detected result as an analog signal.

2. Description of the Related Art

In an apparatus having a drive mechanism incorporated therein such as a video apparatus and a copying machine, a diversity of switches are employed to detect the position of a driving object. For example, for detecting the rotating angular position of a driving object, a rotary switch is often used.

FIG. 4 is a circuit diagram of a 4-bit output rotary switch with a relationship between the predetermined rotating angular positions of a rotor (not shown) and the corresponding outputs thereof shown together. In FIG. 4, reference numeral 2 designates a brush serving as a movable contact that is coupled to the rotor; 3 to 5, switch patterns serving as fixed contacts formed on a not shown board in annular form; 6, a pull-up resistor; 7, an input terminal for inputting a power supply voltage (5 V); and 8, an output terminal for outputting 4-bit data (A, B, C, D).

Numerals 1 to 11 given at the bottommost position in FIG. 4 designate the predetermined rotating angular positions of the rotor. For example, when data to be outputted from the output terminal 8 is (1, 1, 1, 1), it is meant that the brush 2 is located at the rotating angular position 1. When data is changed to (0, 1, 1, 1), it is meant that the brush 2 has moved to the rotating angular position 2 by rotation of the rotor.

Thus, which rotating angular position 1 through 11 the rotor is currently located at can be identified by checking the content of data outputted from the output terminal 8. As a result, the rotating angular position of the driving object coupled to the rotor can be detected.

However, in the case of the aforementioned conventional example, when the rotary switch must be connected to an analog input port of a microcomputer, a D/A converter must be interposed therebetween, which imposes a problem in terms of promoting cost reduction.

A simple modification of a rotary encoder into an analog output type does not give a decisive solution to the problem, because inexpensive circuit parts such as pull-up resistors cannot be used, so that the number of parts is increased and so is the number of wiring points. When a wide voltage range is required in particular, many expensive circuit parts must be employed, which imposes the problem of an increased cost. It may be noted that such problem of increased cost will be described in detail with reference to FIG. 2 later.

This problem is not specific to rotational movement type position detecting switches such as rotary switches, but the same problem is addressed for linear movement type position detecting switches as well.

SUMMARY OF THE INVENTION

The invention has been made in view of the aforementioned circumstances. The object of the invention is, therefore, to provide a position detecting switch free from the aforementioned shortcomings.

To achieve the above object, the invention provides a position detecting switch for detecting at which position out of predetermined selected positions an object whose position is to be detected is located and outputting a detected result as an analog signal, wherein a switch circuit comprises: a plurality of voltage dividing elements for dividing a reference voltage applied from an external source through a reference voltage input terminal; a fixed contact having a plurality of metallic patterns formed on a board, the plurality of metallic patterns being partially notched so as to correspond to the predetermined selected positions; and a movable contact being coupled to the object whose position is to be detected and coming in contact with the metallic patterns serving as the fixed contact so as to slide thereon, wherein the switch circuit not only divides the reference voltage at a voltage dividing ratio corresponding to a currently selected position of the object but also outputs the divided voltage as the analog signal, and wherein out of the plurality of voltage dividing elements, voltage dividing elements for switching the voltage dividing ratios are connected in parallel to one another through the fixed contact and the movable contact.

BRIEF DESCRIPTION OF THE DRAWINGS

FIG. 1 is a circuit diagram of a position detecting switch of a rotational movement type with a relationship between the predetermined rotating angular positions of a rotor and the corresponding outputs thereof shown together;

FIG. 2 is a circuit diagram of a position detecting switch that is assumed to be implemented when a rotary switch of a digital output type is modified into a rotary switch of an analog output type;

FIG. 3 is a diagram illustrative of the embodiment of the invention; i.e., FIG. 3 is a diagram showing the voltage range of an analog signal outputted from the position detecting switch by the level together with a range of voltages judged by a microcomputer and tolerances for calculated center values; FIG. 4 is a circuit diagram of a rotary switch of a digital output type with a relationship between the predetermined rotating angular positions of a rotor and the corresponding outputs thereof shown together.

DETAILED DESCRIPTION OF THE PREFERRED EMBODIMENTS

Figure 1:
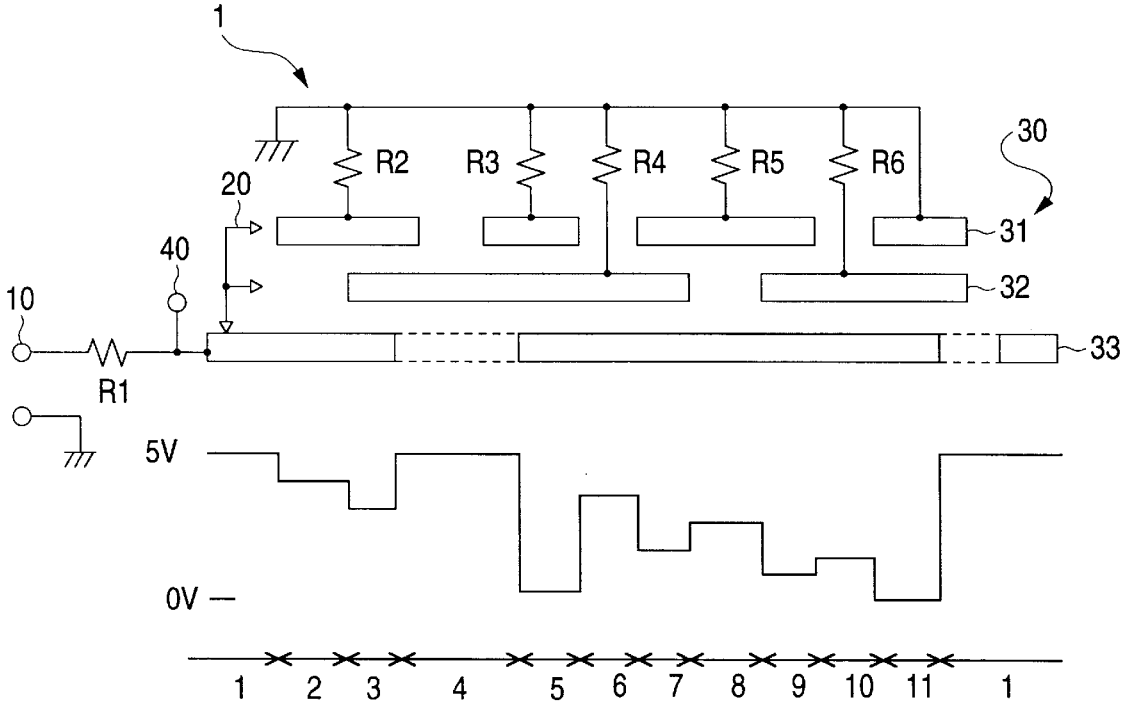
FIG. 1 is a diagram illustrative of an embodiment of the invention; i.e.

An embodiment of the invention will now be described with reference to the drawings. FIG. 1 is a circuit diagram of a position detecting switch of a rotational movement type with a relationship between the predetermined angular positions of a rotor and the corresponding outputs thereof shown together. Here, numerals 1 to 11 given at the bottommost position in FIG. 1 designate the rotating angular positions of the rotor (not shown).

Figure 5:
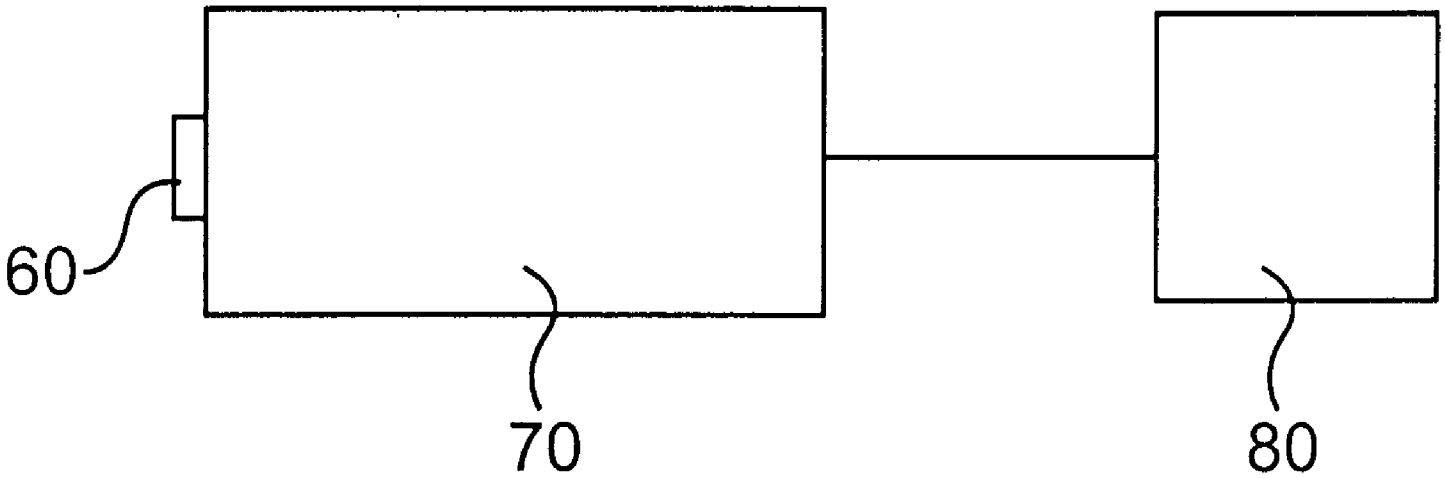
FIG. 5 is a diagram illustrative of a position detecting switch connected to a video apparatus.

The position detecting switch herein described is installed to a video apparatus 80, shown in FIG. 5. The position detecting switch detects which predetermined rotating angular position (corresponding to a selected position) a rotary drive member, which constitutes part of a cassette loading mechanism, is located at, and outputs the detected result as an analog signal. The position detecting switch has such a basic construction as shown in FIG. 1.

In FIG. 1, reference numeral 10 designates a reference voltage input terminal for inputting a reference voltage, which is 5 V in DC, from an external source, and reference numeral 40 designates an output terminal for outputting the analog signal.

Reference numeral 20 designates a movable contact, which is a brush attached to the rotor. The rotary drive member whose position is to be detected is coupled to the movable contact 20 through the rotor that is journaled to a switch main body (not shown).

Reference numeral 30 designates a fixed contact that is attached to a disk-like board (not shown) within the switch main body. On this board are metallic patterns 31 to 33. The metallic patterns 31 to 33 are partially notched so as to correspond to the predetermined rotating angular positions 1 to 11. The movable contact 20 comes in contact with the metallic patterns 31 to 33 so as to slide thereon.

While the metallic patterns 31 to 33 are depicted as if they are linear in FIG. 1, they are actually formed to be annular.

Reference characters R1 to R6 designate voltage dividing elements for dividing the reference voltage applied from the external source through the reference voltage input terminal 10. The respective resistances of these elements are set to: R1=4.7 KΩ; R2=2.2 KΩ; R3=470Ω; R4=10 KΩ; R5=3.6 KΩ; and R6 =1.5 KΩ.

While the resistors are employed as the voltage dividing elements since the reference voltage is a DC voltage in this embodiment, semiconductor circuits or the like that have an electric function equivalent to that of resistors may be employed in place of the resistors.

The movable contact 20, the fixed contact 30, the voltage dividing elements R1 to R6, and the like constitute a switch circuit 1. This switch circuit 1 divides the reference voltage inputted through the reference voltage input terminal 10 at a dividing ratio corresponding to a current rotating angular position of the rotor, and outputs the divided voltage as an analog signal from the output terminal 40.

The most featured characteristic of this switch circuit 1 are the voltage dividing elements R2 to R6 out of the voltage dividing elements R1 to R6, these elements R2 to R6 serving to switch voltage dividing ratios. These voltage dividing elements R2 to R6 are inserted between the metallic pattern 31 or 32 and the ground, and are connected in parallel to one another through the fixed contact 30 and the movable contact 20.

The analog signal outputted from the switch circuit 1 is a DC voltage ranging from 0 to 5 V as shown in FIG. 1 and is introduced into an analog I/O port 60 of a microcomputer 70 that controls the video apparatus. The voltage of the analog signal is indicated from level (1) to level (10) as shown in FIG. 3, according to which a rotating angular position of the rotary drive member whose position is to be detected can be identified by the microcomputer 70.

For example, as shown in FIG. 1, when the rotating angular position of the rotor is 0, the movable contact 20 comes in contact only with the metallic pattern 33, so that the resistor R1 is electrically disconnected from the voltage dividing elements R2 to R6, which in turn causes the reference voltage to appear at the output terminal 40 without being divided. Hence, the voltage of the analog signal is at level (10), which is 5 V. When the rotating angular position of the rotor is 1, the metallic pattern 33 is shorted to the metallic pattern 31 by the movable contact 20, which in turn causes a voltage that is obtained by dividing the reference voltage with the voltage dividing elements R1 and R2 to appear at the output terminal 40. As a result, the voltage of the analog signal is at level (9), which is about 4.1 V. The same applies exactly to the cases where the rotating angular positions of the rotor are 2 to 11.

If resistors having an accuracy of ±10% are used as the voltage dividing elements R1 to R6, the voltage of an analog signal exhibits variations ranging from 0.36 to 0.52 V at level (2), 0.78 to 1.08 V at level (3), . . . , and 3.96 to 4.26 V at level (9) as shown in FIG. 3.

However, even if there are such variations, the microcomputer judges the rotating angular positions of the rotary drive member without error. For example, while the voltage of an analog signal exhibits variations ranging from 0.36 to 0.52 V at level (2), voltages that are judged at the analog I/O port of the microcomputer range from 0.26 to 0.65 V, which means that there are an allowance of 0.18 V on the minus side and an allowance of 0.21 V on the plus side with respect to the calculated center value 0.44 V of the variations ranging from 0.36 to 0.52 V. Therefore, the microcomputer is not likely to make an erroneous judgment. There are also voltage allowances for preventing erroneous judgment for other levels.

Figure 2:
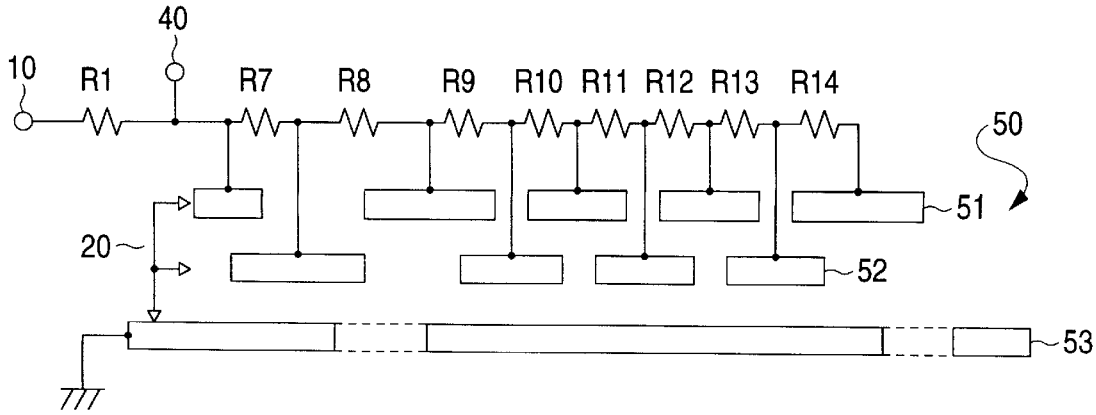
FIG. 2 is a diagram illustrative of effects and the like of the embodiment of the invention; i.e.
Figure 4:
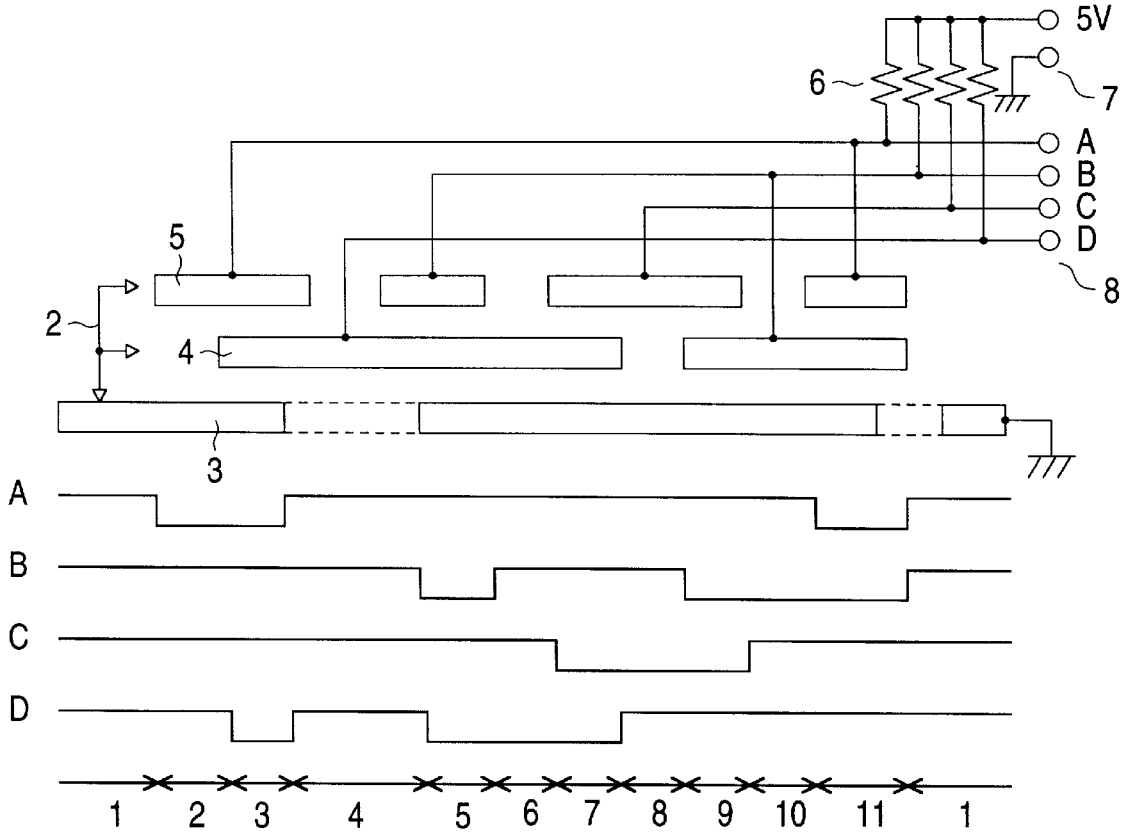
FIG. 4 PRIOR ART
FIG. 4 is a diagram illustrative of a conventional example; i.e.

Incidentally, when the rotary switch shown in FIG. 4 is simply modified into a switch of an analog output type, it is assumed that the construction of the modified switch will be as shown in FIG. 2. Since the same parts and components of the modified switch as those shown in the above example are designated by the same reference numerals, only parts and components thereof different from those shown in the above example will be described.

In FIG. 2, reference numeral 50 designates a fixed contact. Metallic patterns 51 to 53 are formed on the board (not shown). Out of voltage dividing elements R1 and R7 to R14, those R7 to R14 that serve to switch voltage dividing ratios are inserted between the metallic patterns 51 and 52, and are connected in series to one another as a whole. These are the points that distinguish the modified switch from the above example.

In the case of the position detecting switch shown in FIG. 2, a total of 9 voltage dividing elements is required, and the voltage dividing elements are connected to the metallic pattern 51 or 52 at 9 points. In contrast thereto, the invention requires a total of 6 voltage dividing elements, and the voltage dividing elements are connected to the metallic pattern 31 or 32 at 6 points. That is, compared with the case shown in FIG. 2, the number of voltage dividing elements can be reduced by 3, and the number of connecting points between the voltage dividing elements and the metallic patterns can be reduced by 3. Further, in association therewith, the number of leads and connector pins required can also be reduced accordingly.

Hence, not only the parts cost can be reduced, but also the wiring operation can be facilitated, which in turn contributes to curtailing the cost of manufacture as a whole. Of course, unlike the conventional example shown in FIG. 4, the invention, being of the analog output type, requires that no D/A converter be interposed between the switch and the analog input port of a microcomputer, which in turn leads to a cost reduction.

The price of a resistor jumps sharply as the accuracy thereof is increased from ±10% to ±5%, ±2% or ±1%. In the invention, resistors having an accuracy of ±10% can be used as the voltage dividing elements R1 to R6 without problem. With such resistors, the rotating angular positions of the rotary drive member can be detected without error. While the operation of the switch in which resistors having an accuracy of ±10% are used as the voltage dividing elements R1 to R6 has been herein described, a switch in which standard resistors having an accuracy of ±5% are used also operates similarly.

That is, inexpensive resistors can be used as the voltage dividing elements R1 to R6, which contributes to a cost reduction. In addition, the number of resistors can be reduced by 3 compared with the position detecting switch shown in FIG. 2, which contributes to another cost reduction.

The invention is not limited to the aforementioned embodiment, but may be applied, e.g, to another embodiment in which the movable contact 20 is exchanged with the fixed contact 30. That is, the board on which the metallic patterns are formed may be made movable and the brush that comes in contact with the metallic patterns so as to slide thereon may be fixed. Further, the switch is not limited to the rotational movement type, but may, of course, be of a linear movement type.

As described in the foregoing, the position detecting switch according to the invention is of an analog output type. Therefore, even if the switch must be connected to the analog input port of a microcomputer, no A/D converter is required to be interposed therebetween, which in turn contributes to a cost reduction.

Further, being of the analog output type, the switch according to the invention requires a smaller number of voltage dividing elements and a smaller number of connecting points between the voltage dividing elements and the metallic patterns, which in turn contributes to minimizing the number of leads and connector pins as well.

In addition, there is no need for using expensive resistors having a high accuracy as the voltage dividing elements. Even if a wide voltage range is required, the number of voltage dividing elements can be contained to a reasonable value, which in turn promotes a significant cost reduction as a whole.

What is claimed is:

1. A position detecting switch with an analog output for detecting a position out of predetermined selected positions of a first object relative to a second object, wherein a switch circuit comprises:

a first plurality of metallic contacts formed on a board attached to the first object, the first plurality of metallic contacts being physically arranged in a direction of motion of the first object relative to the second object so as to a first plurality of the predetermined selected positions;

a second plurality of metallic contacts formed on the board, the second plurality of metallic contacts being physically arranged in a direction of motion of the first object relative to the second object, and being physically arranged parallel to the first plurality of metallic contacts so as to correspond to a second plurality of the predetermined selected positions;

a third metallic contact formed on the board, the third metallic contact being physically arranged in a direction of motion of the first object relative to the second object and being physically arranged in parallel to the first and second plurality of contacts;

a first plurality of voltage dividing elements having a first node coupled to a first reference voltage of a power supply and having a second node electrically coupled to a corresponding metallic contact of the first plurality of metallic contacts;

a second plurality of voltage dividing elements having a first node electrically coupled to the first reference voltage and having a second node electrically coupled to a corresponding metallic contact of the second plurality of metallic contacts;

a third voltage dividing element, external to the power supply, having a first node electrically coupled to a second reference voltage of the power supply and the second node electrically coupled to the third metallic contact, wherein the analog output is obtained at the third metallic contact and is capable of having a range of voltages; and a fourth metallic contact physically coupled to the second object and positioned so that as the first and second objects move relative to each other, the fourth metallic contact makes slidable contact with the third metallic contact and at least one of the first and second plurality of metallic contacts so as to electrically couple combinations of first and second voltage dividing elements together in parallel, wherein values of the first plurality of voltage dividing elements, second plurality of voltage dividing elements, and third voltage dividing element are selected so that the analog output has a voltage corresponding to the relative position of the first and second objects.

2. The position detecting switch according to claim 1, wherein the first and second plurality of voltage dividing elements are resistors.

3. The position detecting switch according to claim 1, wherein the first and second plurality of voltage dividing elements are semiconductors.

4. The position detecting switch according to claim 1, wherein the first and second plurality of metallic contacts are arranged so that the following conditions occur:

at a first group of the predetermined selected positions at least one of the first plurality of voltage dividing elements and at least one of the second plurality of voltage dividing elements are coupled to the third voltage dividing element;

at a second group of the predetermined selected positions only one of the first plurality of voltage dividing elements is coupled to the third voltage dividing element; and at a third group of the predetermined selected positions only one of the second plurality of voltage dividing elements is coupled to the third voltage dividing element.

* * * * *